US010573174B2

(12) United States Patent
Zhao et al.

(10) Patent No.: US 10,573,174 B2
(45) Date of Patent: Feb. 25, 2020

(54) METHOD FOR JUDGING HIGHWAY ABNORMAL EVENT

(71) Applicants: SHANDONG PROVINCIAL COMMUNICATIONS PLANNING AND DESIGN INSTITUTE, Jinan, Shandong (CN); TSINGHUA UNIVERSITY, Beijing (CN)

(72) Inventors: Kai Zhao, Beijing (CN); Yufeng Bi, Jinan (CN); Yong Li, Beijing (CN); Wei Liu, Jinan (CN); Depeng Jin, Beijing (CN); Weiling Wu, Jinan (CN); Pengfei Zhou, Jinan (CN); Li Su, Beijing (CN); Zhen Tu, Beijing (CN); Tao Mu, Jinan (CN); Peiyang Fang, Jinan (CN); Huajun Pang, Jinan (CN); Chuanyi Ma, Jinan (CN)

(73) Assignees: SHANDONG PROVINCIAL COMMUNICATIONS PLANNING AND DESIGN INSTITUTE, Jinan (CN); TSINGHUA UNIVERSITY, Beijing (CN)

( * ) Notice: Subject to any disclaimer, the term of this patent is extended or adjusted under 35 U.S.C. 154(b) by 0 days.

(21) Appl. No.: 16/318,691

(22) PCT Filed: Mar. 28, 2018

(86) PCT No.: PCT/CN2018/080943
§ 371 (c)(1),
(2) Date: Jan. 17, 2019

(87) PCT Pub. No.: WO2019/007111
PCT Pub. Date: Jan. 10, 2019

(65) Prior Publication Data

US 2019/0189005 A1 Jun. 20, 2019

(30) Foreign Application Priority Data

Jul. 4, 2017 (CN) ..... 2017 1 0538098

(51) Int. Cl.
*G08G 1/01* (2006.01)
*G08G 1/052* (2006.01)

(52) U.S. Cl.
CPC ..... *G08G 1/0133* (2013.01); *G08G 1/0112* (2013.01); *G08G 1/052* (2013.01)

(58) Field of Classification Search
CPC ... G08G 1/0104; G08G 1/0112; G08G 1/0133
See application file for complete search history.

(56) References Cited

U.S. PATENT DOCUMENTS 6,131,064 A 10/2000 Vieweg
9,576,481 B2 * 2/2017 Xu ..... G08G 1/0125
(Continued)

FOREIGN PATENT DOCUMENTS

CN 104408923 A 3/2015
CN 104933862 A 9/2015
(Continued)

OTHER PUBLICATIONS

Ong et al., "Traffic Jams Detection Using Flock Mining", Joint European Conference on Machine Learning and Knowledge Discovery in Databases, Lecture Notes in Computer Science, vol. 6913, Sep. 2011, pp. 650-653. (Year: 2011).*
(Continued)

*Primary Examiner* — Todd M Melton
(74) *Attorney, Agent, or Firm* — Oliff PLC

(57) ABSTRACT

The present invention provides a method for judging a highway abnormal event, which can determine the traffic jam phenomenon in the target road segment based on the trajectory data of each sample vehicle of the target road segment. The solution of the present invention has the
(Continued)

following beneficial effects of 1. comprehensively considering the vehicle speed information of the sample vehicles to judge the traffic jam event; 2. determining the overall traffic jam event of the target road segment; 3. more accurately judging the traffic jam event of the target road segment.

10 Claims, 4 Drawing Sheets

(56) References Cited

U.S. PATENT DOCUMENTS

| | | | | |
|---|---|---|---|---|
| 9,761,133 | B2 * | 9/2017 | Macfarlane | G08G 1/0129 |
| 10,068,469 | B2 * | 9/2018 | Bradley | G08G 1/0141 |
| 10,163,339 | B2 * | 12/2018 | Liu | G08G 1/0112 |

FOREIGN PATENT DOCUMENTS

| | | | |
|---|---|---|---|
| CN | 105489008 | A | 4/2016 |
| CN | 106205126 | A | 12/2016 |
| CN | 106781486 | A | 5/2017 |
| CN | 107293117 | A | 10/2017 |
| DE | 102013010321 | A1 | 12/2013 |
| EP | 0 789 341 | A1 | 8/1997 |

OTHER PUBLICATIONS

Krogh et al., "Trajectories for Novel and Detailed Traffic Information", Proceedings of the 3rd ACM SIGSPATIAL International Workshop on GeoStreaming, Nov. 2012, pp. 32-39. (Year: 2012).*

Wang et al., "Visual Traffic Jam Analysis Based on Trajectory Data", IEEE Transactions on Visualization and Computer Graphics, vol. 19 No. 12, Oct. 2013, pp. 2159-2168. (Year: 2013).*

Wang et al., "A Feature-Based Method for Traffic Anomaly Detetction", Proceedings of the 2nd ACM SIGSPATIAL Workshop on Smart Cities and Urban Analytics, Oct. 2016, pp. 1-8. (Year: 2016).*

Jun. 7, 2018 Written Opinion issued on Chinese Patent Application No. PCT/CN2018/080943.

Jun. 7, 2018 International Search Report issued in International Patent Application No. PCT/CN2018/080943.

* cited by examiner

METHOD FOR JUDGING HIGHWAY ABNORMAL EVENT

FIELD OF INVENTION

The present invention relates to the technical field of traffic data analysis, and more particularly to a method for judging a highway abnormal event.

BACKGROUND OF INVENTION

At present, with the acceleration of urbanization and the construction of expressways, the travel mode through the expressways has become more and more common. At the same time, however, with the continuous increase of the per capita car ownership in China and the increase in the travel demands of people, especially during the holidays, the traffic volumes on the expressways are very large. In addition, as the handling of accidents on the expressways is troublesome, traffic jams often occur. Highway traffic jams have the characteristics of large scale, long time, difficult handling and the like, which have a great impact on the travel of people. Therefore, the analysis of the specific situation of traffic jams on the expressways, such as the road sections that are prone to traffic jams, and the time length of traffic jams, is of great help to the optimization design of the traffic planning stage and the real-time analysis and processing after the jam occurs.

On the other hand, with the improvement of living standards of people, positioning mobile devices such as mobile phones have become indispensable items in the daily lives of people. People carry the mobile phones around in the daily travels, and the movement of the mobile phones basically reflects the movement of people. In addition, the positioning technology of the mobile devices is also developing very rapidly, a mobile operator can judge the location of a user according to a base station connected with the mobile phone, a GPS positioning function of the smart phone can also locate the position of the user, and the accuracy has reached tens of meters. Therefore, a large amount of mobile phone movement information is recorded. From these massive mobile phone movement data, we can derive the moving speed of the user, and the moving speed also represents the moving speed of the vehicle on the expressway, so that we can analyze the traffic conditions on the expressway and have a comprehensive understanding of the traffic jam.

The following highway traffic jam condition judgment methods exist in the prior art. Patent 1 relates to a real-time detection method of an abnormal highway event based on mobile phone data. Whether an abnormal event occurs is judged according to the change of a mobile phone access number of the base station. The mobile phone access number of the base station at a future moment is predicted in real time via a time series model, and an abnormal event judgment indicator is calculated to determine whether the abnormal event occurs. Patent 2 relates to a jam recognition and road condition sharing excitation system based on the mobile Internet. The user shares traffic jam information on the Internet to spread the traffic jam information, which is equivalent to an information sharing platform where the users communicate with each other about the traffic jam conditions. Paper 3 involves research on road condition estimation algorithm based on mobile devices. The moving speed of a single vehicle is firstly constructed by using the GPS information of the mobile phone, then the average speed of the same type of vehicles is estimated, and the traffic condition is judged through the average speed of the vehicles.

In summary, the existing related documents have the following technical problems: 1) in the patent 1, the judgment is performed on the basis of the mobile phone access number of the base station, but the access amount has a relatively large relation with the traffic flow, and does not reflect the most essential characteristic of the traffic jam, that is, the speed of the vehicle, so the traffic information during the traffic jam cannot be completely reflected. 2) The patent 2 relates to an information sharing platform of traffic jam scenarios, but this platform is mainly for users and is not suitable for the traffic department to collect complete traffic jam information. 3) The data in the paper 3 utilizes the manually generated traffic GPS data and very fine-grained data collected by specialized mobile phone applications, but in reality, such data cannot be obtained, so the application scope is not wide.

SUMMARY OF INVENTION

The present invention provides a method for judging a highway abnormal event in order to overcome the above problems or at least partially solve the above problems.

According to one aspect of the present invention, a method for judging a highway abnormal event is provided, including:

step 1: obtaining trajectory data of sample vehicles passing a target road segment H within a target time period T;

step 2, equally dividing the T and the H respectively, and constructing a two-dimensional matrix U representing the discretized trajectories of the sample vehicles based on the equally divided T and H;

step 3, calculating an average speed of the sample vehicles at spatio-temporal points in the discretized trajectories, and adding the average speed of the spatio-temporal points to the two-dimensional matrix U;

step 4: calculating a total number of sample vehicles at the spatio-temporal points in the discretized trajectories and the average speed of all sample vehicles at the spatio-temporal points in the discretized trajectories; and step 5: obtaining traffic jam conditions in the T and the H based on the total number of sample vehicles at the spatio-temporal points in the discretized trajectories and the average speed of all sample vehicles at the spatio-temporal points in the discretized trajectories.

Further, the step 1 further includes:

selecting a closed polygon A around the target road segment, so that the shortest distance from any point on the A to the target road segment is equal, wherein the shortest distance is the maximum positioning offset distance of the sample vehicle that can be positioned on the target road segment; the trajectories of the sample vehicles are obtained and are expressed as $S=[(t_1,l_1), (t_2,l_2), \ldots, (t_n,l_n)]$, wherein the ith record $R=(t_i,l_i)$ expresses that the time is $t_i$, and the location of the sample vehicle is $l_i$.

Further, the step 2 further includes:

dividing the H into m continuous road segments $H=H_1+H_2+\ldots+H_m$ with equal lengths;

dividing the T into n time periods with equal intervals, wherein the intermediate time point of the time segment i is expressed as $T_i$; and constructing the two-dimensional matrix U representing the discretized trajectories of the sample vehicles based on the divided road segments and time periods.

Further, the step of constructing the two-dimensional matrix U representing the discretized trajectories of the sample vehicles based on the divided road segments and time periods in the step 2 further includes:

finding starting points $H_a$ and ending points $H_b$ of the trajectories $S=[(t_1,l_1), (t_2,l_2), \ldots, (t_n,l_n)]$ of the sample vehicles, wherein $l_1 \in H_a, l_2 \in H_b$, and the H is expressed as $H_{ab}=\{H_a, H_{a+1}, \ldots, H_b\}$;

finding starting time points $T_c$ and ending time points $T_d$ respectively corresponding to the trajectories $t_1$ and $t_n$ of the sample vehicles, wherein $T_{c-1}<t_1 \leq T_d, T_c \leq t_2 < T_{d+1}$, and the time points included in the trajectories of the sample vehicles are expressed as $T_{cd}=\{T_c, T_{c+1}, \ldots, T_d\}$;

finding location information corresponding to the time points $T_i$ in the trajectories of the sample vehicles, wherein $t_k<T_i<t_{k+1}$, wherein the trajectory points corresponding to the $t_k$ and $t_{k+1}$ are $P(t_k,l_k),Q(t_{k+1},l_{k+1})$;

obtaining the road segment $H_i$ corresponding to the $T_i$ based on the $l_k$ and the $l_{k+1}$; and constructing the two-dimensional matrix U representing the discretized trajectories of the sample vehicles based on the $T_i$ and $H_i$, wherein the discretized trajectories are expressed as $S'=[(H_1,T_1),(H_2,T_2),(H_2,T_3),(H_3,T_4),(H_5,T_5), \ldots]$.

Further, the step of obtaining the road segment $H_i$ corresponding to the $T_i$ based on the $l_k$ and the $l_{k+1}$ in the step 2 further includes:

when the $l_k$ and the $l_{k+1}$ are on the same segment of trajectory $H_i$, indicating that the road segment corresponding to the sample vehicle at the moment $T_i$ is $H_i$;

when the $l_k$ and the $l_{k+1}$ are respectively located on two different road segments Hj and Hj+r, assuming that the sample vehicle performs uniform linear motion between the $l_k$ and the $l_{k+1}$; calculating the speed $$v = \frac{\|l_{k+1} - l_k\|}{t_{k+1} - t_k}$$

between the $l_k$ and the $l_{k+1}$, obtaining that the sample vehicle is located between the $l_k$ and the $l_{k+1}$ at the moment $T_i$, and indicating that the distance from the $l_k$ is $v\cdot(t_{k+1}-t_k)$, that is, the geographical location of the target vehicle is $W=l_k+v\cdot(t_{k+1}-t_k)$; and finding the road segment where the W is located from the $H_{ab}$, that is, the road segment $H_i$ corresponding to the sample vehicle at the moment $T_i$.

Further, the step of calculating the average speed of the sample vehicles at spatio-temporal points in the discretized trajectories in the step 3 further includes:

for any discretized trajectory point of the sample vehicle, finding from the original trajectory $S=[(t_1,l_1), (t_2,l_2), \ldots, (t_n,l_n)]$ two trajectory points X and Y before and after the any discretized trajectory point respectively, wherein the X and Y are closest to the any discretized trajectory point and are not located on the same road segment as the any discretized trajectory point; and expressing the average speed of the sample vehicle at the any discretized trajectory point by using the average speed of the road segment between the X and the Y.

Further, the step of calculating the total number of sample vehicles at the spatio-temporal points in the discretized trajectories in the step 4 further includes:

merging the trajectory matrixes U of all sample vehicles into a three-dimensional matrix $D=[U_1, U_2, \ldots, U_u]$, wherein u represents the number of the sample vehicles, $D_x$, $D_y$, $D_z$ respectively represent three dimensions of the three-dimensional matrix D, namely, the road segment, the time and the user, any element D(i,j,k) in the matrix represents the number of users at the ith road segment and the jth time point; and expressing the total number of the sample vehicles at the spatio-temporal points in the discretized trajectories by using a two-dimensional matrix E, wherein E(i,j) represents the number of users at the ith road segment and the jth time point; and traversing the two dimensions of $D_x$ and $D_y$ of the three-dimensional matrix D to find a non-empty element set $D'_{ij}$, $E(i,j)=|D'_{ij}|$ in the D(i,j,:) for all i and j.

Further, the step of calculating the average speed of all sample vehicles at the spatio-temporal points in the discretized trajectories in the step 4 further includes:

recording the average speed of each road segment in a speed two-dimensional matrix F, wherein F(i,j) represents the average speed of all sample vehicles at the ith road segment and the jth time point:

$$F(i,j) = \begin{cases} \dfrac{\sum_{v \in D'_{ij}} v}{E(i,j)} & D'_{ij} = \emptyset \\ \text{NULL} & D'_{ij} \neq \emptyset \end{cases}.$$

Further, the step 5 further includes:

when the average vehicle speed of any spatio-temporal point in the T and the H is smaller than a preset threshold $v_{jam}$, and the total number of the sample vehicles of any spatio-temporal point is greater than a preset threshold $n_{jam}$, confirming that traffic jam occurs at the any spatio-temporal point, wherein $$n_{jam} = \frac{m \cdot \Delta_d}{l} \cdot n,$$

$\Delta_d$ represents the length of the road segment, m represents the number of one-way lanes, l represents the average length of a vehicle body, and n represents the average passenger capacity of the sample vehicle; and storing the judgment result of traffic jam conditions of all spatio-temporal points in the T and the H in a two-dimensional binary matrix J.

Further, the step 5 further includes:

performing average pooling processing on the matrix, figuring out an average value of elements of the J matrix in a window by using a square pooling window, and finding the location of the pooling window where the average value is greater than a preset threshold, wherein the location is the location where the traffic jam occurs; and selecting a starting time $T_x$, an ending time $T_y$, a starting location $H_x$ and an ending location $H_y$ of the location where the traffic jam occurs; and calculating the average speed $\bar{v}$ of a sub-matrix corresponding to the location where the traffic jam occurs by using the matrix F; and obtaining $E_i=\{T_1,T_2,L_1,L_2,\bar{v}\}$.

The present application provides a method for judging a highway abnormal event. The solution of the present invention has the following beneficial effects of 1. comprehensively considering the vehicle speed information of the sample vehicles to judge the traffic jam event; 2. determining the overall traffic jam event of the target road segment; 3. more accurately judging the traffic jam event of the target road segment.

DETAILED DESCRIPTION OF THE EMBODIMENTS

The specific embodiments of the present invention are further described in detail below with reference to the drawings and embodiments. The following embodiments are used for illustrating the present invention, rather than limiting the scope of the present invention.

Figure 1:
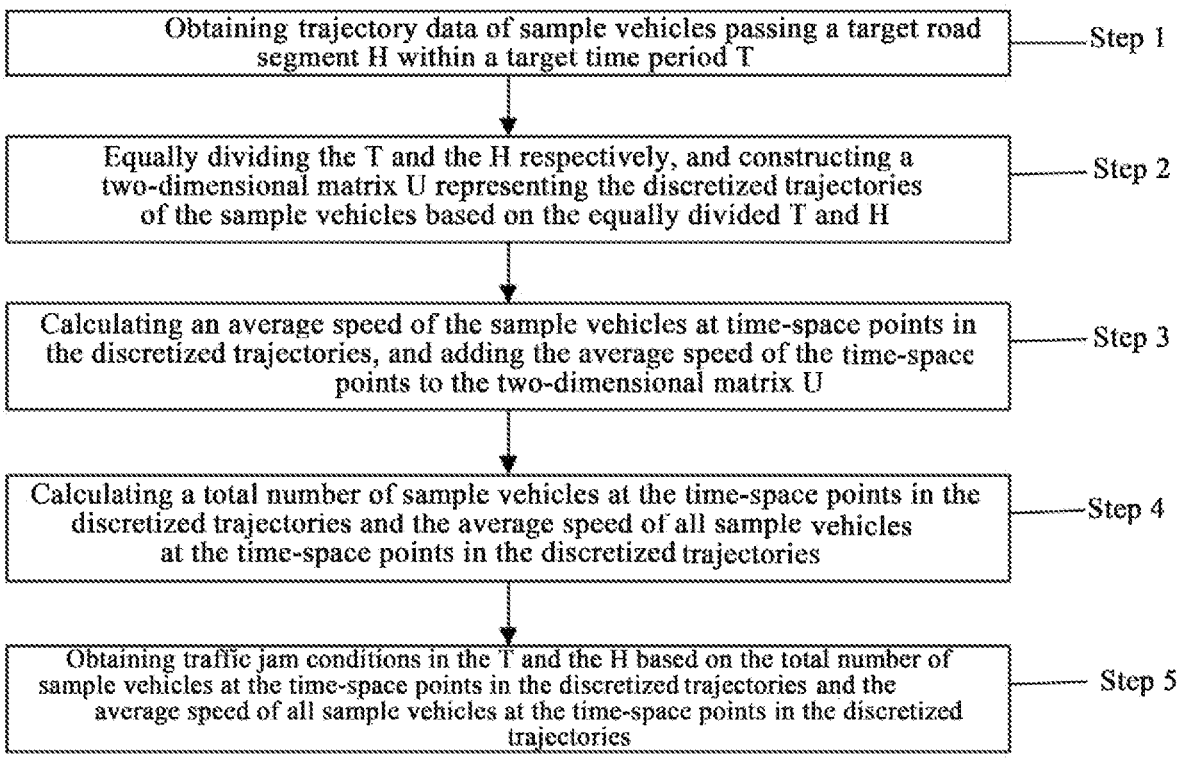
FIG. 1 is an overall flow schematic diagram of a method for judging a highway abnormal event according to an embodiment of the present invention.

As shown in FIG. 1, in a specific embodiment of the present invention, an overall flow schematic diagram of a method for judging a highway abnormal event is shown. Generally, the method includes:

step 1: obtaining trajectory data of sample vehicles passing a target road segment H within a target time period T;

step 2, equally dividing the T and the H respectively, and constructing a two-dimensional matrix U representing the discretized trajectories of the sample vehicles based on the equally divided T and H;

step 3, calculating an average speed of the sample vehicles at spatio-temporal points in the discretized trajectories, and adding the average speed of the spatio-temporal points to the two-dimensional matrix U;

step 4: calculating a total number of sample vehicles at the spatio-temporal points in the discretized trajectories and the average speed of all sample vehicles at the spatio-temporal points in the discretized trajectories; and step 5: obtaining traffic jam conditions in the T and the H based on the total number of sample vehicles at the spatio-temporal points in the discretized trajectories and the average speed of all sample vehicles at the spatio-temporal points in the discretized trajectories.

On the basis of any above specific embodiment, the present invention provides the method for judging the highway abnormal event, and the step 1 further includes:

selecting a closed polygon A around the target road segment, so that the shortest distance from any point on the A to the target road segment is equal, wherein the shortest distance is the maximum positioning offset distance of the sample vehicle that can be positioned on the target road segment; the trajectories of the sample vehicles are obtained and are expressed as $S=[(t_1,l_1), (t_2,l_2), \ldots, (t_n,l_n)]$, wherein the ith record $R=(t_i,l_i)$ expresses that the time is $t_i$, and the location of the sample vehicle is $l_i$.

On the basis of any above specific embodiment, the present invention provides the method for judging the highway abnormal event, and the step 2 further includes:

dividing the H into m continuous road segments $H=H_1+H_2+\ldots+H_m$ with equal lengths; dividing the T into n time periods with equal intervals, wherein the intermediate time point of the time segment i is expressed as $T_i$; and constructing the two-dimensional matrix U representing the discretized trajectories of the sample vehicles based on the divided road segments and time periods.

On the basis of any above specific embodiment, the present invention provides the method for judging the highway abnormal event, and the step of constructing the two-dimensional matrix U representing the discretized trajectories of the sample vehicles based on the divided road segments and time periods in the step 2 further includes:

finding starting points $H_a$ and ending points $H_b$ of the trajectories $S=[(t_1,l_1), (t_2,l_2), \ldots, (t_n,l_n)]$ of the sample vehicles, wherein $l_1 \in H_a, l_2 \in H_b$, and the H is expressed as $H_{ab}=\{H_a, H_{a+1}, \ldots, H_b\}$;

finding starting time points $T_c$ and ending time points $T_d$ respectively corresponding to the trajectories $t_1$ and $t_n$ of the sample vehicles, wherein $T_{c-1}<t_1\leq T_d, T_c\leq t_2<T_{d+1}$, and the time points included in the trajectories of the sample vehicles are expressed as $T_{cd}=\{T_c, T_{c+1}, \ldots, T_d\}$;

finding location information corresponding to the time points $T_i$ in the trajectories of the sample vehicles, wherein $t_k<T_i<t_{k+1}$, wherein the trajectory points corresponding to the $t_k$ and $t_{k+1}$ are $P(t_k,l_k), Q(t_{k+1},l_{k+1})$;

obtaining the road segment $H_i$ corresponding to the $T_i$ based on the $l_k$ and the $l_{k+1}$; and constructing the two-dimensional matrix U representing the discretized trajectories of the sample vehicles based on the $T_i$ and $H_i$, wherein the discretized trajectories are expressed as $S'=[(H_1,T_1),(H_2,T_2),(H_2,T_3),(H_3,T_4),(H_5,T_5), \ldots]$.

On the basis of any above specific embodiment, the present invention provides the method for judging the highway abnormal event, and the step of obtaining the road segment $H_i$ corresponding to the $T_i$ based on the $l_k$ and the $l_{k+1}$ in the step 2 further includes:

when the $l_k$ and the $l_{k+1}$ are on the same segment of trajectory $H_i$, indicating that the road segment corresponding to the sample vehicle at the moment $T_i$ is $H_i$;

when the $l_k$ and the $l_{k+1}$ are respectively located on two different road segments Hj and Hj+r, assuming that the sample vehicle performs uniform linear motion between the $l_k$ and the $l_{k+1}$; calculating the speed $$v = \frac{\|l_{k+1} - l_k\|}{t_{k+1} - t_k}$$

between the $l_k$ and the $l_{k+1}$, obtaining that the sample vehicle is located between the $l_k$ and the $l_{k+1}$ at the moment $T_i$, and indicating that the distance from the $l_k$ is $v\cdot(t_{k+1}-t_k)$, that is, the geographical location of the target vehicle is $W=l_k+v\cdot(t_{k+1}-t_k)$; and finding the road segment where the W is located from the $H_{ab}$, that is, the road segment $H_i$ corresponding to the sample vehicle at the moment $T_i$.

On the basis of any above specific embodiment, the present invention provides the method for judging the highway abnormal event, and the step of calculating the average speed of the sample vehicles at spatio-temporal points in the discretized trajectories in the step 3 further includes:

For any discretized trajectory point of the sample vehicle, finding from the original trajectory $S=[(t_1,l_1), (t_2,l_2), \ldots, (t_n,l_n)]$ two trajectory points X and Y before and after the any discretized trajectory point respectively, wherein the X and Y are closest to the any discretized trajectory point and are not located on the same road segment as the any discretized trajectory point; and expressing the average speed of the sample vehicle at the any discretized trajectory point by using the average speed of the road segment between the X and the Y.

On the basis of any above specific embodiment, the present invention provides the method for judging the highway abnormal event, and the step of calculating the total number of sample vehicles at the spatio-temporal points in the discretized trajectories in the step 4 further includes:

merging the trajectory matrixes U of all sample vehicles into a three-dimensional matrix $D=[U_1, U_2, \ldots, U_u]$, wherein u represents the number of the sample vehicles, $D_x$, $D_y$, $D_z$ respectively represent three dimensions of the three-dimensional matrix D, namely, the road segment, the time and the user, any element D(i,j,k) in the matrix represents the number of users at the ith road segment and the jth time point; and expressing the total number of the sample vehicles at the spatio-temporal points in the discretized trajectories by using a two-dimensional matrix E, wherein E(i,j) represents the number of users at the ith road segment and the jth time point; and traversing the two dimensions of $D_x$ and $D_y$ of the three-dimensional matrix D to find a non-empty element set $D'_{ij}$, $E(i,j)=|D'_{ij}|$ in the D(i,j,:) for all i and j.

On the basis of any above specific embodiment, the present invention provides the method for judging the highway abnormal event, and the step of calculating the average speed of all sample vehicles at the spatio-temporal points in the discretized trajectories in the step 4 further includes:

recording the average speed of each road segment in a speed two-dimensional matrix F, wherein F(i,j) represents the average speed of all sample vehicles at the ith road segment and the jth time point:

$$F(i,j)=\begin{cases}\dfrac{\sum_{v\in D'_{ij}} v}{E(i,j)} & D'_{ij}=\phi \\ \text{NULL} & D'_{ij}\neq\phi\end{cases}.$$

On the basis of any above specific embodiment, the present invention provides the method for judging the highway abnormal event, and the step 5 further includes:

when the average vehicle speed of any spatio-temporal point in the T and the H is smaller than a preset threshold $v_{jam}$, and the total number of the sample vehicles of any spatio-temporal point is greater than a preset threshold $n_{jam}$, confirming that traffic jam occurs at the any spatio-temporal point, wherein $$n_{jam}=\frac{m\cdot\Delta_d}{l}\cdot n,$$

$\Delta_d$ represents the length of the road segment, m represents the number of one-way lanes, l represents the average length of a vehicle body, and n represents the average passenger capacity of the sample vehicle; and storing the judgment result of traffic jam conditions of all spatio-temporal points in the T and the H in a two-dimensional binary matrix J.

On the basis of any above specific embodiment, the present invention provides the method for judging the highway abnormal event, and the step 5 further includes:

performing average pooling processing on the matrix, figuring out an average value of elements of the J matrix in a window by using a square pooling window, and finding the location of the pooling window where the average value is greater than a preset threshold, wherein the location is the location where the traffic jam occurs; and selecting a starting time $T_x$, an ending time $T_y$, a starting location $H_x$ and an ending location $H_y$ of the location where the traffic jam occurs; and calculating the average speed $\bar{v}$ of a sub-matrix corresponding to the location where the traffic jam occurs by using the matrix F;

and obtaining $E_i=\{T_1,T_2,L_1,L_2,\bar{v}\}$.

In another specific embodiment of the present invention, a method for judging a highway abnormal event is provided. In the method, an abnormal event of the user on an expressway between two specific cities is identified by analyzing mobile phone signaling data. The present embodiment mainly uses the GPS data of the mobile phone (user ID | time | latitude and longitude), and the trajectory of the user is formed by continuous spatio-temporal location records. The specific judgment solution is as follows.

1. Input: the trajectory data of a large number of users on a certain intercity expressway within a period of time, the trajectory of each user is expressed as $S=[(t_1,l_1), (t_2,l_2), \ldots, (t_n,l_n)]$, wherein the ith record $R_i(t_i,l_i)$ represents that the connection time is $t_i$, and the location is $l_i$.

2. Output: whether the abnormal event occurs on the road segment within the time period, if a traffic jam condition occurs, the information $[E_1, E_2, \ldots]$ of the traffic jam is provided, wherein $E_i$ represents a traffic jam event, $E_i=\{T_1, T_2,L_1,L_2,\bar{v}\}$, $T_1$ and $T_2$ respectively represent the starting time and the ending time of the traffic jam, $L_1$ and $L_2$ respectively represent the starting location and the ending location of the road segment with traffic jam, and $\bar{v}$ represents the average speed during the traffic jam.

3. The specific implementation method is as follows.

Step 1, the trajectory of the user on the expressway is extracted.

Figure 2:
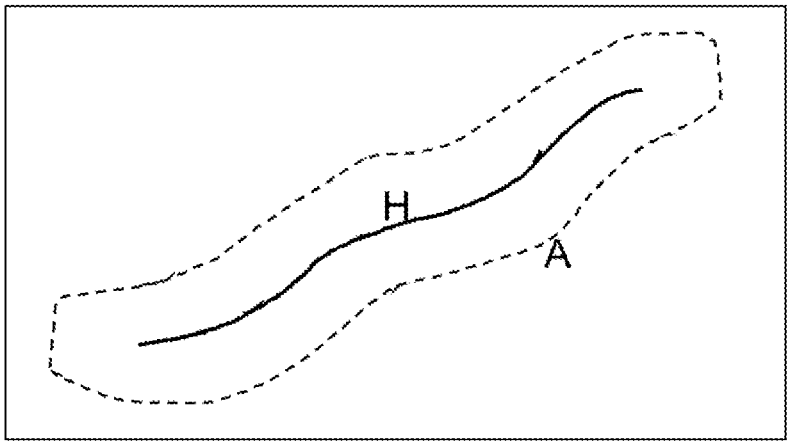
FIG. 2 is a schematic diagram of a positioning range of a target road segment in a method for judging a highway abnormal event according to an embodiment of the present invention.

The starting point and the ending point of the trajectory of the user may be not on the expressway. As we only study the abnormal event on the expressway (the segment of expressway is expressed by H), a part of the trajectory of the user in the expressway needs to be intercepted at first. The specific method is to find the expressway on the map, and then manually select a closed polygon A around the expressway, so that the distance from any point on the polygon to the expressway is roughly similar, as shown in FIG. 2. For the distance value, reference can be made to the accuracy of the positioning method to ensure that the points of normal deviation can be included. Then, for any trajectory $S=[(t_1, l_1), (t_2,l_2), \ldots, (t_n,l_n)]$ all points inside the polygon are found, that is $\{(t_i,l_i)|l_i\in A\}$, to form a new trajectory. For the convenience of expression, we still use $S=[(t_1,l_1), (t_2,l_2), \ldots, (t_n,l_n)]$ to express the new trajectory in the following steps.

Step 2, the trajectory of the user is divided by the road segments.

Figure 3:
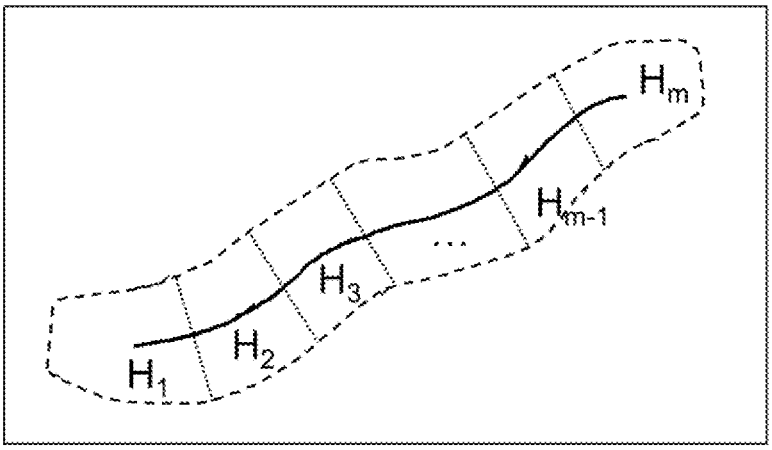
FIG. 3 is a division schematic diagram of a target road segment in a method for judging a highway abnormal event according to an embodiment of the present invention.

The expressway is divided into m continuous road segments with equal lengths according to a certain distance $\Delta_d$ interval, $H=H_1+H_2+\ldots+H_m$, as shown in FIG. 3. The entire time period of the data set is divided into n discrete time periods with equal time intervals according to a certain time interval $\Delta_t$, and the intermediate time point of each time period is expressed as $T_i$. For each user, a two-dimensional matrix U is formed by the discrete time periods and the road segments to express the trajectory of the user, a non-empty value in the matrix U indicates that the user appears at the spatio-temporal point, and one trajectory is equivalent to a set of discrete points.

Step 3, the trajectory of the user is discretized.

Figure 4:
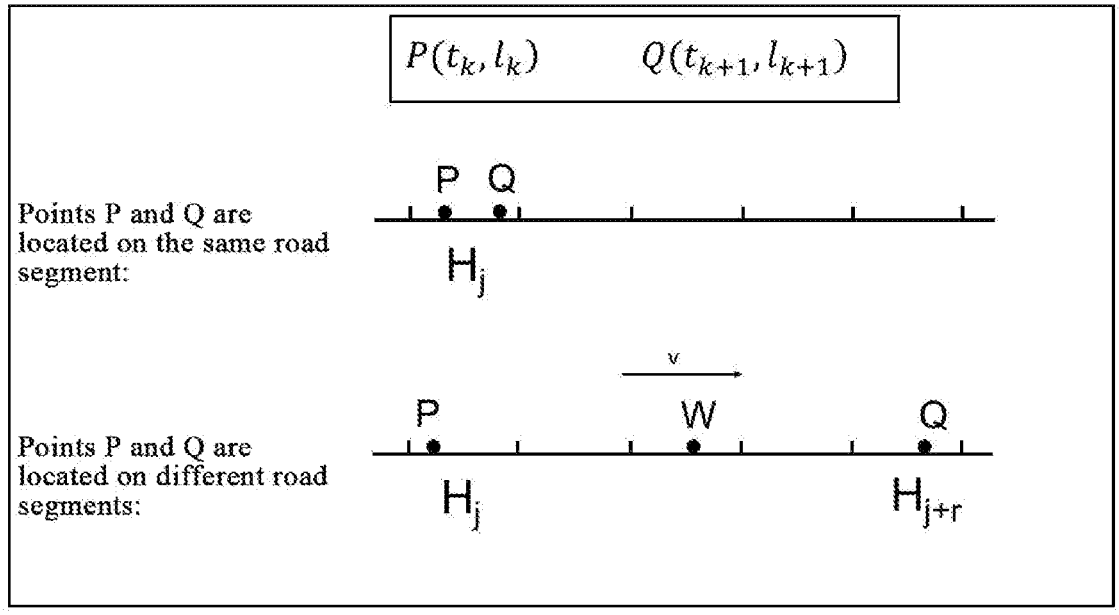
FIG. 4 is a schematic diagram of calculating a road segment where a vehicle is located at a moment of $T_i$ in the method for judging a highway abnormal event according to an embodiment of the present invention.

For each trajectory $S=[(t_1,l_1), (t_2,l_2), \ldots, (t_n,l_n)]$, the corresponding road segments of the starting point and the ending point are found and are expressed as $H_a,H_b$, wherein $l_1 \in H_a$, $l_n \in H_b$, and the whole road segment where the trajectory is located is expressed as $H_{ab}=\{H_a, H_{a+1}, \ldots, H_b\}$ Then the time points $T_c,T_d$ corresponding to the starting point and the ending point $t_1,t_n$ are found, wherein $T_{c-1}<t_1 \leq T_d$, $T_c \leq t_n < T_{d+1}$, the time point contained in the trajectory is expressed as $T_{cd}=\{T_c, T_{c+1}, \ldots, T_d\}$. The road segment of the user is found when the user is located at each point. For any time point $T_i$, the location $(t_k<T_i<t_{k+1})$ in the trajectory is found, the corresponding trajectory points are respectively $P(t_k,l_k),Q(t_{k+1})$ the trajectory segments where the $l_k$ and the $l_{k+1}$ are located are found, and there are two situations, as shown in FIG. 4.

$l_k$ and $l_{k+1}$ are on the same segment of trajectory $H_j$: then at the moment $T_i$, the trajectory segment where the vehicle is located is $H_j$;

$l_k$ and $l_{k+1}$ are not on the same segment of trajectory: assuming that they are located on $H_j$ and $H_{j+r}$, and a movement process between the two points is approximately uniform linear motion, the speed $$v = \frac{\|l_{k+1} - l_k\|}{t_{k+1} - t_k}$$

between the two points is calculated at first, then it is obtained that the vehicle is located between the $l_k$ and the $l_{k+1}$ at the moment $T_i$, and the distance from the $l_k$ is $v\cdot(t_{k+1}-t_k)$, namely, the geographical location of the vehicle is approximately $W=l_k+v\cdot(t_{k+1}-t_k)$. The road segment where the geographical location is located is found from $H_{ab}$, that is, a high-speed road segment where the vehicle is located.

As shown in Table 1, in a spatio-temporal discretized two-dimensional matrix U, the trajectories of the user can be connected by discrete points of a shaded part to be expressed as $S'=[(H_{k_1},T_a), (H_{k_2},T_{a+1}), \ldots, (H_{k_{b-a+1}},T_b)]$, wherein $k_i$ represents the trajectory segment where the user is located at the moment $T_{a+i-1}$. For the example in Table 1, the discretized trajectory can be expressed as $S'=[(H_1,T_1),(H_2,T_2),(H_2,T_3),(H_3,T_4),(H_5,T_5), \ldots]$.

TABLE 1 matrix U formed by discretized trajectorys

| | $T_1$ | $T_2$ | $T_3$ | $T_4$ | $T_5$ | . . . | Tn |
|---|---|---|---|---|---|---|---|
| $H_1$ | 1 | | | | | | |
| $H_2$ | | 2 | 3 | | | | |
| $H_3$ | | | | 4 | | | |
| $H_4$ | | | | | | | |
| $H_5$ | | | | | 5 | | |
| . . . | | | | | | | |
| $H_m$ | | | | | | | |

Step 4, the average speed of each point in the discrete trajectory is calculated.

Figure 5:
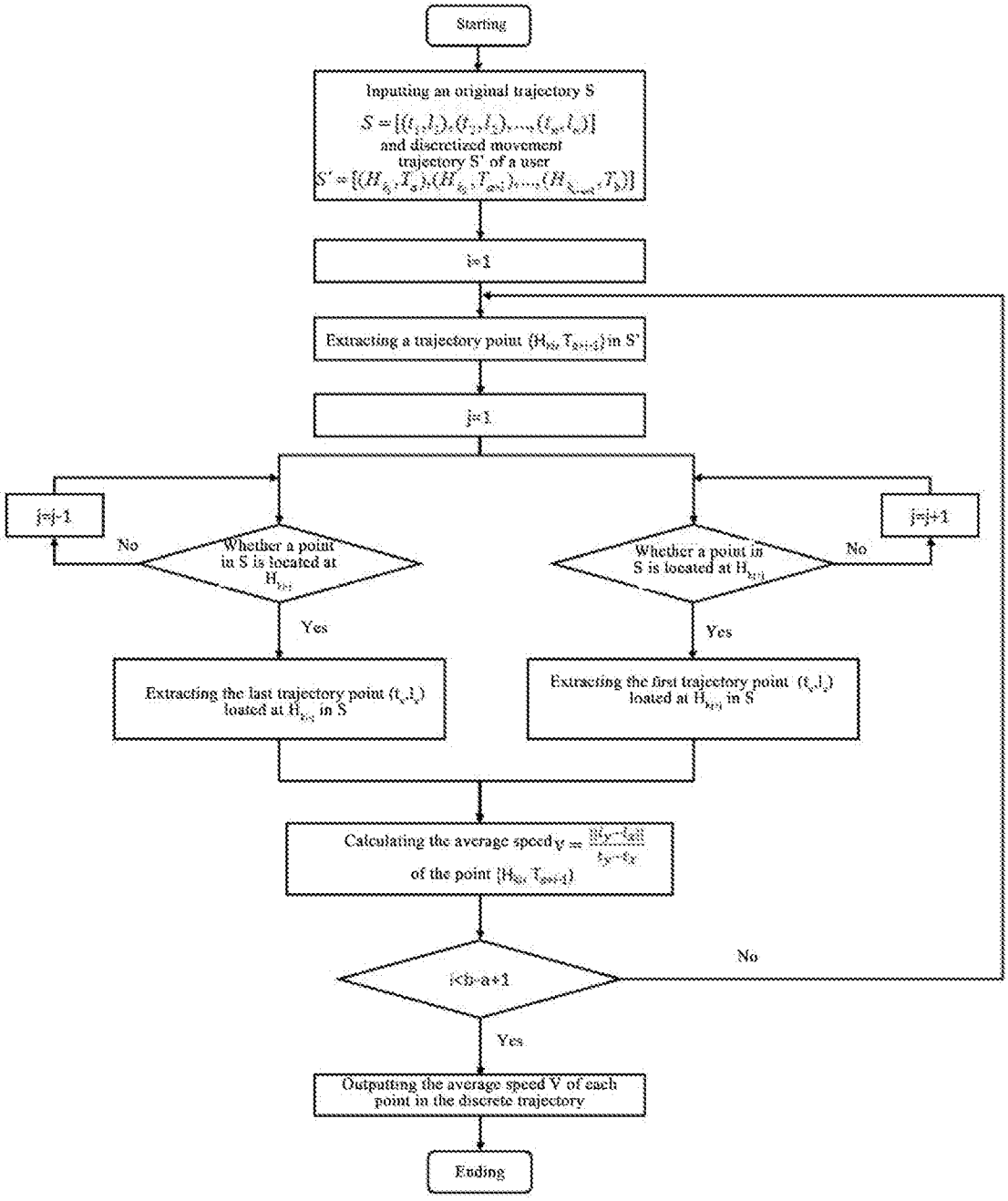
FIG. 5 is a schematic diagram of a speed calculation flow of a trajectory point in a discretized trajectory in a method for judging a highway abnormal event according to an embodiment of the present invention.
Figure 6:
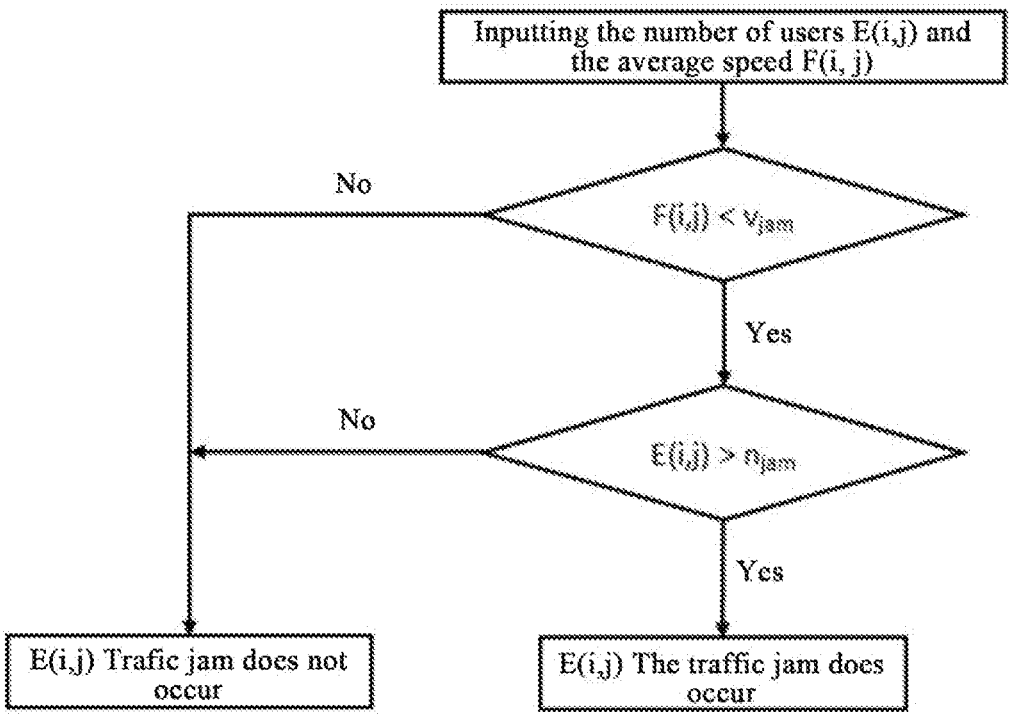
FIG. 6 is a schematic diagram of a traffic jam judging flow of a spatio-temporal point in a method for judging a highway abnormal event according to an embodiment of the present invention.

After the trajectory of the user is discretized, the average speed of each discrete trajectory point is calculated. The general idea is to find from the original trajectory $S=[(t_1,l_1), (t_2,l_2), \ldots, (t_n,l_n)]$ two trajectory points X and Y before and after the any discretized trajectory point respectively, and it should be satisfied that the two points are not located on the same road segment as the discrete point. The average speed of the road segment between the two points is used for expressing the speed of the discrete point, and the specific flow chart is as shown in FIG. 5.

For each point $Z(H_k,T_{a+i-1})$ in the discrete trajectory, forward check X and backward check Y are performed simultaneously. During the forward check, whether a recording point in the original trajectory is located at $H_{k_i-1}$ is judged at first, if so, the last recording point (closest to the discrete point Z) in these recording points is extracted as X, if not, the forward check is performed at $H_{k_i-2}$ until the recording point is found; and during the backward check, whether the recording point in the original trajectory is located at $H_{k_i+1}$ is judged at first, if so, the first recording point (closest to the discrete point Z) in these recording points is extracted as Y, if not, the backward check is performed at $H_{k_i+2}$ until the recording point is found. In particular, if Z is the starting point of the discrete trajectory, then the Y is checked backward only, and the average speed between ZY is used for expressing the speed of the point Z; if Z is the end point of the discrete trajectory, X is checked forward only, and the average speed between XZ is used for expressing the speed of the point Z. The calculated average speed of each point is expressed as $v_i$, the speeds of all discrete points are expressed as $V=[v_1, v_2, \ldots, v_{b-a+1}]$ and are filled in the matrix U.

Step 5, the average speed of all spatio-temporal points and the number of users are calculated. In order to judge whether a traffic jam occurs at each spatio-temporal point, we need to calculate the number of users and the average moving speed of each spatio-temporal point. Firstly, the trajectory matrixes U of all users are merged together to form a three-dimensional matrix $D=[U_1, U_2, \ldots, U_u]$, wherein u represents the number of users. Therefore, the three dimensions $D_x$, $D_y$, $D_z$ are respectively the road segment, the time and the user. Any element D(i,j,k) in the matrix represents the speed of the kth user at the ith road segment and the jth time point. If the user is not at the location at the moment, the element value is null. The matrix D is a sparse matrix.

Firstly, the number of users at each spatio-temporal point is calculated and is expressed by a two-dimensional matrix E, and E(i,j) represents the number of users at the ith road segment and the jth time point. The two dimensions $D_x$, $D_y$ of a three-dimensional speed matrix D are traversed, for all i, j, a non-empty element set $D'_{ij}$ in the D(i,j,:) is found, then the $E(i,j)=|D'_{ij}|$, and $|D'_{ij}|$ represents the size of the set D Next, the average speed of each road segment at each time point is calculated and is recorded in a speed two-dimensional matrix F, F(i,j) represents the average speed of all users at the ith road segment and the jth time point. The calculation formula of F(i,j) is as follows:

$$F(i,j) = \begin{cases} \dfrac{\sum_{v \in D'_{ij}} v}{E(i,j)} & D'_{ij} = \emptyset \\ \text{NULL} & D'_{ij} \neq \emptyset \end{cases}.$$

Step 6, whether a traffic jam occurs at any spatio-temporal point is judged.

According to the user number matrix E and the average speed matrix F, we can judge whether the traffic jam occurs at any spatio-temporal point. The judgment flow is shown in FIG. 5. Firstly, whether the speed of the point is abnormal is judged, that is, less than the normal high-speed travelling speed. We set a speed threshold $v_{jam}$. If the speed is less than the speed, it indicates that the traffic jam may occur. The minimum speed limit of the domestic expressways is 60 km/h, so the threshold can be set as 60 km/h. However, the judgment from the speed alone does not fully explain the abnormal situation. Maybe only a small number of users are collected, and when their positioning has problems, the speed magnitude cannot be reflected. Therefore, the number of users here and now will be further verified, generally, the traffic jam will cause a large amount of vehicles on the road, the number of users collected at this time will also be an abnormal situation. Whether the number of users reaches a threshold $n_{jam}$ is judged, if it is greater than the value, it indicates that the traffic jam occurs, otherwise it is considered that the speed judgment is wrong. The setting of $n_{jam}$ is estimated based on the length $\Delta_d$ of the road division, the number m of one-way lanes, the average length l of the vehicle body, and the average passenger capacity n of the vehicle, and the calculation formula is $$n_{jam} = \frac{m \cdot \Delta_d}{l} \cdot n.$$

The judgment result is stored in a two-dimensional binary matrix J, $$J(i, j) = \begin{cases} 1, \text{There is a traffic jam in the } ith \text{ road segment at the } jth \text{ moment} \\ 0, \text{There is no traffic jam in the } ith \text{ road segment at the } jth \text{ moment} \end{cases}$$

The process of a traffic jam is reflected as spatio-temporal points with a value of 1 partially aggregating in the matrix J, as shown in the example in Table 2, the traffic jam occurs between the road segments $H_2$~$H_5$ within the time period $T_2$~$T_5$.

TABLE 2 example of matrix J

| | $T_1$ | $T_2$ | $T_3$ | $T_4$ | $T_5$ | . . . | Tn |
|---|---|---|---|---|---|---|---|
| $H_1$ | 0 | 0 | 0 | 0 | 0 | | 0 |
| $H_2$ | 0 | 0 | 0 | 1 | 1 | | 0 |
| $H_3$ | 0 | 1 | 1 | 1 | 0 | | 0 |
| $H_4$ | 0 | 1 | 1 | 1 | 1 | | 0 |
| $H_5$ | 0 | 1 | 1 | 0 | 0 | | 0 |
| . . . | | | | | | . . . | |
| $H_m$ | 0 | 0 | 0 | 0 | 0 | 0 | 0 |

In order to eliminate some errors in the judgment process, especially the judgment errors at the very beginning and ending of the traffic jam, median filtering is performed in J, so that it is smoother.

Step 7, whether the traffic jam occurs at any spatio-temporal point is judged.

J has provided the situation of whether the traffic jam occurs at any spatio-temporal point, and according to the average speed matrix F, we can also know the average speed at each spatio-temporal point during the traffic jam, so the matrix J better reflects the scenario of the traffic jam. In order to extract an entire traffic jam scenario, we perform an average pooling operation on the J, the average of elements of the matrix J in a square pooling window is figured out by using the window, the location of the pooling window where the average value is greater than a set threshold is found, and the location is the location where the traffic jam occurs. Then, the starting time $T_1$, the ending time $T_2$, the starting location $H_1$ and the ending location $H_2$ of the traffic jam are manually found, which is similar to the minimum sub-matrix containing a red area in table 2. Then, the average speed $\bar{v}$ of the sub-matrix is calculated through the matrix F. Then, the $E=\{T_1,T_2,L_1,L_2,\bar{v}\}$ is output.

Finally, the method of the present application is only a preferred embodiment and is not intended to limit the protection scope of the present invention. Any modifications, equivalent substitutions, improvements and the like made within the spirit and scope of the present invention shall all be included in the protection scope of the present invention.

The invention claimed is:

1. A method for judging a highway abnormal event is provided, including:

step 1: obtaining trajectory data of sample vehicles passing a target road segment H within a target time period T;

step 2: equally dividing the T and the H respectively, and constructing a two-dimensional matrix U representing the discretized trajectorys of the sample vehicles based on the equally divided T and H;

step 3: calculating an average speed of the sample vehicles at spatio-temporal points in the discretized trajectorys, and adding the average speed of the spatio-temporal points to the two-dimensional matrix U;

step 4: calculating a total number of sample vehicles at the spatio-temporal points in the discretized trajectorys and the average speed of all sample vehicles at the spatio-temporal points in the discretized trajectorys; and step 5: obtaining traffic jam conditions in the T and the H based on the total number of sample vehicles at the spatio-temporal points in the discretized trajectorys and the average speed of all sample vehicles at the spatio-temporal points in the discretized trajectorys.

2. The method according to claim 1, wherein the step 1 further includes:

selecting a closed polygon A around the target road segment, so that the shortest distance from any point on the A to the target road segment is equal, wherein the shortest distance is the maximum positioning offset distance of the sample vehicle that can be positioned on the target road segment; and the trajectorys of the sample vehicles are obtained and are expressed as $S=[(t_1,l_1), (t_2,l_2), \ldots, (t_n,l_n)]$, wherein the ith record $R_i=(t_i,l_i)$ expresses that the time is $t_i$, and the location of the sample vehicle is $l_i$.

3. The method according to claim 2, wherein the step 2 further includes:

dividing the H into m continuous road segments $H=H_1+H_2+\ldots+H_m$ with equal lengths;

dividing the T into n time periods with equal intervals, wherein the intermediate time point of the time segment i is expressed as $T_i$; and constructing the two-dimensional matrix U representing the discretized trajectorys of the sample vehicles based on the divided road segments and time periods.

4. The method according to claim 3, wherein the step of constructing the two-dimensional matrix U representing the discretized trajectorys of the sample vehicles based on the divided road segments and time periods in the step 2 further includes:

finding starting points $H_a$ and ending points $H_b$ of the trajectories $S=[(t_1,l_1), (t_2,l_2), \ldots, (t_n,l_n)]$ of the sample vehicles, wherein $l_1 \in H_a$, $l_n \in H_b$, and the H is expressed as $H_{ab}=\{H_a, H_{a+1}, \ldots, H_b\}$;

finding starting time points $T_c$ and ending time points $T_d$ respectively corresponding to the trajectorys $t_1$ and $t_n$ of the sample vehicles, wherein $T_{c-1}<t_1 \leq T_d$, $T_c \leq t_n < T_{d+1}$, and the time points included in the trajectorys of the sample vehicles are expressed as $T_{cd}=\{T_c, T_{c+1}, \ldots, T_d\}$;

finding location information corresponding to the time points $T_i$ in the trajectorys of the sample vehicles, wherein $t_k<T_i<t_{k+1}$, wherein the trajectory points corresponding to the $t_k$ and $t_{k+1}$ are $P(t_k,l_k),Q(t_{k+1},l_{k+1})$;

obtaining the road segment $H_i$ corresponding to the $T_i$ based on the $l_k$ and the $l_{k+1}$; and constructing the two-dimensional matrix U representing the discretized trajectorys of the sample vehicles based on the $T_i$ and $H_i$, wherein the discretized trajectorys are expressed as $S'=[(H_1,T_1),(H_2,T_2),(H_2,T_3),(H_3,T_4),(H_5,T_5), \ldots]$.

5. The method according to claim 4, wherein the step of obtaining the road segment $H_i$ corresponding to the $T_i$ based on the $l_k$ and the $l_{k+1}$ in the step 2 further includes:

when the $l_k$ and the $l_{k+1}$ are on the same segment of trajectory $H_i$, indicating that the road segment corresponding to the sample vehicle at the moment $T_i$ is $H_i$;

when the $l_k$ and the $l_{k+1}$ are respectively located on two different road segments Hj and Hj+r, assuming that the sample vehicle performs uniform linear motion between the $l_k$ and the $l_{k+1}$;

calculating the speed $$v = \frac{\|l_{k+1} - l_k\|}{t_{k+1} - t_k}$$

between the $l_k$ and the $k_{k+1}$, obtaining that the sample vehicle is located between the $l_k$ and the $l_{k+1}$ at the moment $T_i$, and indicating that the distance from the $l_k$ is $v\cdot(t_{k+1}-t_k)$, that is, the geographical location of the target vehicle is $W=l_k+v\cdot(t_{k+1}-t_k)$; and finding the road segment where the W is located from the $H_{ab}$, that is, the road segment $H_i$ corresponding to the sample vehicle at the moment $T_i$.

6. The method according to claim 5, wherein the step of calculating the average speed of the sample vehicles at spatio-temporal points in the discretized trajectorys in the step 3 further includes:

for any discretized trajectory point of the sample vehicle, finding from the original trajectory $S=[(t_1,l_1), (t_2,l_2), \ldots, (t_n,l_n)]$ two trajectory points X and Y before and after the any discretized trajectory point respectively, wherein the X and Y are closest to the any discretized trajectory point and are not located on the same road segment as the any discretized trajectory point; and expressing the average speed of the sample vehicle at the any discretized trajectory point by using the average speed of the road segment between the X and the Y.

7. The method according to claim 6, wherein the step of calculating the total number of sample vehicles at the spatio-temporal points in the discretized trajectorys in the step 4 further includes:

merging the trajectory matrixes U of all sample vehicles into a three-dimensional matrix $D=[U_1, U_2, \ldots, U_n]$, wherein u represents the number of the sample vehicles, $D_x$, $D_y$, $D_z$ respectively represent three dimensions of the three-dimensional matrix D, namely, the road segment, the time and the user, any element D(i,j,k) in the matrix represents the number of users at the ith road segment and the jth time point;

expressing the total number of the sample vehicles at the spatio-temporal points in the discretized trajectorys by using a two-dimensional matrix E, wherein E(i,j) represents the number of users at the ith road segment and the jth time point; and traversing the two dimensions of $D_x$ and $D_y$ of the three-dimensional matrix D to find a non-empty element set $D'_{ij}$; $E(i,j)=|D'_{ij}|$ in the D(i,j,:) for all i and j.

8. The method according to claim 7, wherein the step of calculating the average speed of all sample vehicles at the spatio-temporal points in the discretized trajectorys in the step 4 further includes:

recording the average speed of each road segment in a speed two-dimensional matrix F, wherein F(i,j) represents the average speed of all sample vehicles at the ith road segment and the jth time point:

$$F(i,j) = \begin{cases} \dfrac{\sum_{v \in D'_{ij}} v}{E(i,j)} & D'_{ij} = \emptyset \\ \text{NULL} & D'_{ij} \neq \emptyset \end{cases}.$$

9. The method according to claim 8, wherein the step 5 further includes:

when the average vehicle speed of any spatio-temporal point in the T and the H is smaller than a preset threshold $v_{jam}$, and the total number of the sample vehicles of any spatio-temporal point is greater than a preset threshold $n_{jam}$, confirming that traffic jam occurs at the any spatio-temporal point, wherein $$n_{jam} = \frac{m \cdot \Delta_d}{l} \cdot n,$$

$\Delta_d$ represents the length of the road segment, m represents the number of one-way lanes, l represents the average length of a vehicle body, and n represents the average passenger capacity of the sample vehicle; and storing the judgment result of traffic jam conditions of all spatio-temporal points in the T and the H in a two-dimensional binary matrix J.

10. The method according to claim 9, wherein the step 5 further includes:

performing average pooling processing on the matrix, figuring out an average value of elements of the J matrix in a window by using a square pooling window, and finding the location of the pooling window where the average value is greater than a preset threshold, wherein the location is the location where the traffic jam occurs;

selecting a starting time $T_x$, an ending time $T_y$, a starting location $H_x$ and an ending location $H_y$ of the location where the traffic jam occurs; and calculating the average speed $\bar{v}$ of a sub-matrix corresponding to the location where the traffic jam occurs by using the matrix F; and obtaining $E_i=\{T_1, T_2, L_1, L_2, \bar{v}\}$.

* * * * *